US008684791B2

(12) United States Patent
Stern

(10) Patent No.: US 8,684,791 B2
(45) Date of Patent: Apr. 1, 2014

(54) LINEAR, AUTOMATED APPARATUS AND METHOD FOR CLEAN, HIGH PURITY, SIMULTANEOUS LAPPING AND POLISHING OF OPTICS, SEMICONDUCTORS AND OPTOELECTRONIC MATERIALS

(76) Inventor: Alvin Gabriel Stern, Newton, MA (US)

( * ) Notice: Subject to any disclaimer, the term of this patent is extended or adjusted under 35 U.S.C. 154(b) by 97 days.

(21) Appl. No.: 13/373,267

(22) Filed: Nov. 9, 2011

(65) Prior Publication Data

US 2013/0115860 A1 May 9, 2013

(51) Int. Cl.
*B24B 7/22* (2006.01)

(52) U.S. Cl.
CPC ..... *B24B 7/228* (2013.01)
USPC ..... 451/11; 451/41

(58) Field of Classification Search
CPC ..... B24B 7/228
USPC ..... 451/5, 11, 41, 312, 314, 317
See application file for complete search history.

(56) References Cited

U.S. PATENT DOCUMENTS 5,487,697 A * 1/1996 Jensen ..... 451/324
6,626,736 B2 * 9/2003 Tsujimura et al. ..... 451/9
6,626,744 B1 * 9/2003 White et al. ..... 451/66
6,726,545 B2 * 4/2004 Balakumar et al. ..... 451/59
6,837,774 B2 * 1/2005 Hu et al. ..... 451/8
7,004,825 B1 * 2/2006 Taylor et al. ..... 451/72
7,104,867 B2 * 9/2006 Jeong ..... 451/11
2002/0123298 A1 * 9/2002 Krusell et al. ..... 451/5
2002/0164936 A1 * 11/2002 Smith et al. ..... 451/307
2003/0139124 A1 * 7/2003 Xu ..... 451/307
2003/0203710 A1 * 10/2003 Balakumar et al. ..... 451/59
2007/0021043 A1 * 1/2007 Birang et al. ..... 451/296
2007/0202777 A1 * 8/2007 Yasui ..... 451/36
2008/0085662 A1 * 4/2008 Sekiya et al. ..... 451/59

* cited by examiner

*Primary Examiner* — Maurina Rachuba

(57) ABSTRACT

A linear, automated apparatus and method for clean, cost-effective, simultaneous lapping and polishing of optics, semiconductors and optoelectronic materials is presented, constructed principally from corrosion resistant stainless steel or nickel, enabling utilization of high purity water based abrasive slurry. The circular stainless steel or nickel lapping plate of the apparatus supports a synthetic nylon or rayon pad, whereby material is abraded from the workpiece primarily through the reciprocal, back and forth, linear movement of the workpiece holder, diametrically across the circular lapping plate, with intermittent rotation in step increments of the workpiece holder and affixed workpiece, tracing arcs of 180 degrees, first in a clockwise and subsequently counterclockwise direction. Intermittent rotation of the circular lapping plate for the sole purpose of ensuring uniform wear on the circular nylon or rayon pad and lapping plate, eliminates the need for periodic, time consuming conditioning or reflattening of the lapping plate.

9 Claims, 6 Drawing Sheets

LINEAR, AUTOMATED APPARATUS AND METHOD FOR CLEAN, HIGH PURITY, SIMULTANEOUS LAPPING AND POLISHING OF OPTICS, SEMICONDUCTORS AND OPTOELECTRONIC MATERIALS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The technology of lapping and polishing of optical components and other materials has existed for many hundreds of years and consists in its most simple and basic form of bringing the material to be lapped and/or polished into close physical contact with a flat plate loaded with fine abrasive either in a powder form or in a slurry, and moving in a repetitive pattern until sufficient material is removed from the workpiece to achieve the desired flatness and/or surface roughness. Many centuries have passed since the early era when optics for the first telescopes and microscopes were lapped and polished by hand by skilled craftsmen, however, the fundamental methods for lapping and polishing optical components, semiconductor and optoelectronic materials remain the same, with the principal difference that in contemporary times, automated lapping machines have largely replaced hand lapping and polishing methods and techniques.

Modern automated lapping and polishing machines invariably consist of a circular wheel or lapping plate fabricated from either cast iron or a composite material, rotating about its central axis powered by an electric motor. Either one or in some cases up to three or more workpiece holders are held in place near to the periphery of the rotating lapping plate by armature type assemblies that allow the workpiece holders to rotate about their own central axes while the large diameter lapping plate rotates beneath. The workpiece holder uses either vacuum or wax to secure the workpiece that is to be lapped and/or polished when in contact with the lapping plate. A slurry mix containing an abrasive such as diamond, alumina or boron carbide suspended in solution is dripped at a controlled rate onto the rotating lapping plate to effect material removal from the work piece(s). The lapping action is achieved through the simultaneous rotations of the workpiece holder and affixed workpiece about its own axis and the rotation of the large diameter lapping plate, in contact with the workpiece affixed to the holder. The contemporary automated approach to lapping and polishing provides many advantages over hand lapping including, much higher productivity, since the lapping machine can be operated continuously with minimal human intervention compared to hand lapping and polishing which requires continuous human exertion. There exist however, a number of significant drawbacks to the present techniques used in the automated apparatus for lapping and/or polishing. The principal drawback involves the very geometry and mechanics of the automated lapping apparatus which places the workpiece holders at the periphery of the lapping plate. Such placement of the workpieces, causes uneven wear of the plate after prolonged lapping and/or polishing with the apparatus. Conditioning of the lapping plate is then required to return it to a proper flatness, a process which is both time consuming and labor intensive and reduces the overall productivity of the machine.

A second further drawback of the existing automated lapping technology and apparatus includes the lapping plate materials which are predominantly either cast iron or copper composite. Cast iron is relatively soft and is capable of safely lapping a wide range of modern materials including those used in conventional optics such as glasses, as well as crystalline materials such as semiconductors and optoelectronic materials. Silicon and other semiconductor materials can be safely lapped with cast iron without risk of introducing impurities that can degrade the electronic properties of the semiconductors. Cast iron however, is intended for lapping only and cannot lap and polish a material simultaneously. Therefore, materials that are lapped directly on a cast iron plate must subsequently be polished using polishing pads woven most commonly from synthetic nylon or rayon fibers. Cast iron is prone to rusting and cannot be used over a prolonged time period with high purity water based abrasive slurries. This poses significant problems in terms of maintaining cleanliness for lapping sensitive semiconductor materials. In contrast to cast iron, the more recently developed copper composite lapping plates are useful for both the lapping and simultaneous polishing of materials which saves time and cost, in not having to polish a material after lapping using separate polishing pads. Unfortunately, the copper composite plates cannot be used for lapping and polishing silicon since the electronic properties of silicon are severely degraded by copper atom impurity in the silicon, unless the silicon material is used exclusively in optical rather than optoelectronic applications.

The ideal automated lapping machine will therefore combine the important characteristics of having a lapping plate fabricated from a corrosion resistant material that will support the use of clean, high purity water based abrasive slurries appropriate for lapping the full range optical glasses, semiconductors and optoelectronic materials while simultaneously polishing them. In addition, the lapping plate material must not contaminate any semiconductor workpieces that are meant to be lapped and polished. The method of lapping and polishing implemented by the apparatus on the workpieces should abrade the lapping plate uniformly on its entire surface, as to prevent non-uniform wear that requires time consuming and labor intensive, periodic conditioning or reflattening of the lapping plate.

An alternative method that allows for simultaneously lapping and polishing of the full range of optical materials including crystalline semiconductors and other optoelectronic materials in a clean manner using high purity water based abrasive slurries, and without a need to condition or reflatten the lapping plate, is described by the present invention. The present invention introduces a method for constructing an automated apparatus to perform simultaneous lapping and polishing of the full range of optical and optoelectronic materials using high purity water based abrasive slurry, without having to recondition the lapping plate. The lapping and polishing apparatus of the present invention can be implemented by using corrosion resistant stainless steel or nickel material for the lapping plate together with a synthetic nylon or rayon polishing pad affixed to said stainless steel or nickel plate. The workpiece holder uses vacuum to retain the workpiece. The primary lapping action is achieved in the apparatus by a linear, reciprocal, back and forth translation of the workpiece holder with affixed workpiece diametrically across the nylon or rayon pad, rigidly supported by the stainless steel or nickel lapping plate, which is loaded with a clean, high purity water based abrasive slurry. The linear movement of the workpiece and holder traces a straight line path across the center of the circular lapping plate. A secondary motion occurs in the apparatus as the workpiece holder with affixed workpiece, is rotated intermittently in step increments, tracing arcs of 180 degrees, first in a clockwise and subsequently counterclockwise direction, thereby ensuring that the workpiece is lapped uniformly against the nylon or rayon pad supported by the stainless steel or nickel lapping plate. The stainless steel or nickel lapping plate is also rotated about its own axis to ensure that any wear on the nylon or rayon pad and stainless steel or nickel plate is uniform over the full area. The rotation of the stainless steel or nickel lapping plate however, is much slower than the frequency or rate of the linear, reciprocal back and forth translation of the workpiece holder, as such rotation of the lapping plate serves only to ensure uniform wear of the plate and nylon or rayon pad rather than actual abrading or material removal from the workpiece.

In summary, the manifold advantages of the method and apparatus of the present invention for lapping optical, semiconductor and optoelectronic materials include the capability of simultaneously lapping and polishing such materials while maintaining a high level of cleanliness and purity provided by water based abrasive slurries needed for semiconductor materials, at the same time wearing the stainless steel or nickel lapping plate and synthetic nylon or rayon pad uniformly, thereby obviating any need for time consuming and labor intensive conditioning or reflattening of the stainless steel or nickel lapping plate resulting from non-uniform wear. In many regards, the apparatus of the present invention automates the mechanical motion of the workpiece as would be performed by hand lapping, whereby the workpiece holder with affixed workpiece is linearly translated in a repetitive, reciprocal manner across the lapping plate while also intermittently rotated about its own axis in small angular increments, to ensure uniform lapping of the workpiece. The advantages provided by the mechanical movements of the workpiece emulating the workpiece movements of hand lapping, include a very uniform coverage and attendant uniform wear of the stainless steel or nickel lapping plate, from having the workpiece traverse the entire diametric length of the stainless steel or nickel lapping plate with each linear stroke of movement. The large stainless steel or nickel lapping plate therefore does not have to be rotated continuously since the sole purpose for its rotation is to ensure uniform wear across the surface, rather than for the abrading or removal of material from the workpiece which is accomplished rather, primarily through the linear, reciprocal movement of the workpiece.

Although other automated apparatus designs and methods exist for lapping and/or polishing optical, semiconductor and optoelectronic materials, the alternative existing methods and automated apparatus do not offer the capability for simultaneously lapping and polishing the full range of optical, semiconductor and optoelectronic materials in a single linear, automated apparatus using clean, high purity water based abrasive slurry with a corrosion resistant stainless steel or nickel lapping plate supporting an affixed polishing pad of woven nylon or rayon material. Other methods and automated apparatus implement the lapping action using the more conventional, continuous rotational movement of the lapping plate beneath the workpiece which is positioned at the edge of the lapping plate, resulting in a non-uniform wear of the lapping plate, while in the present invention, a highly stable linear, reciprocal motion of the workpiece diametrically across the lapping plate with only intermittent rotation of the stainless steel or nickel lapping plate, ensures uniform Wear of the plate and obviates the need for periodic conditioning or reflattening of the lapping plate.

As illustrated in U.S. patent application Ser. No. 10/599,562, the method and apparatus proposed for polishing a workpiece relies on linear abrasive finishing rather than rotary abrasive finishing. A pair of adjacent parallel flat surface plates move linearly in opposite directions and the workpiece is pressed onto both of the plates and the workpiece is subjected to abrasive finishing by the relative movement between the rotation of the workpiece and the linear movement of the pair of surface plates. Belt polishers passing over a workpiece support may be used instead of the surface plates. The described invention for a linearly advancing polishing method and apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed circular workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 5,487,697, the method and apparatus proposed for polishing a workpiece relies on using a rotary work holder travelling down a rail for polishing a workpiece with linear pads. The polishing pads have a long linear dimension relative to their width with uniform cross-section along the linear dimension and the wafer holder travels in a straight line parallel to the long linear dimension of the polishing pads. The described invention for a linear polishing method and apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 5,749,769, the apparatus for a lapping process using microadvancement is described for optimizing the flatness of a magnetic head air bearing surface. The lapping machine includes a lapping plate having a grinding surface, a linear motion for moving the air bearing surface over the grinding surface in a first linear direction and a micro-advance mechanism for controllably advancing the workpiece over the grinding surface in a second direction that is perpendicular simultaneously, to provide a highly polished air bearing surface. The described invention for a linear polishing method and apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 6,908,368, the method for implementing an advanced bi-directional linear polishing system is described where the chemical mechanical apparatus uses a portion of a polishing pad that is disposed under tension between a supply spool and a receive spool, with a motor providing the tension to either the supply spool or the receive spool and the other spool being locked during processing while the motor also advances the polishing pad if needed. A feedback mechanism ensures that consistent tension of the polishing pad is maintained. The described invention for a linear polishing method and apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. patent application Ser. No. 10/134,821, the method for implementing a linear polishing apparatus is described for improving the substrate uniformity. The linear polishing apparatus intended for polishing a semiconductor substrate has a polishing belt arrangement with at least two polishing belts forming a continuous loop with each belt having an outside polishing surface and smooth inside surface and are mounted side by side sharing a common axis at each end. A platen interposes each belt and is placed between the rollers, providing a polishing plane having a plurality of holes for compressed gas to impart an upward pressure against the polishing belts. The described invention for a linear polishing method and apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. patent application Ser. No. 09/820,107, the method for implementing a linear chemical polishing apparatus equipped with programmable pneumatic support platten is described which allows for controlling the polishing profile on a wafer surface during a linear CMP process. The programmable pneumatic platen is positioned juxtaposed to the bottom of a continuous belt for the linear CMP apparatus and positioned corresponding to the wafer carrier to force the polishing pad against the wafer surface to be polished using a plurality of holes for gas pressure to be applied in a predetermined pattern to the polishing pad in contact with the wafer. The described invention for a linear polishing method and apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 6,462,409, the method for implementing a semiconductor wafer polishing apparatus is presented whereby a robotic handling system moves the semiconductor wafer between a belt module and a rotary module for respective linear and rotary polishing. A buff module and cleaning module are also provided in the system housing for buffing and cleaning the semiconductor wafer. The described invention for a semiconductor wafer polishing apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 6,589,105, a method and system for pad tensioning in a bidirectional linear polisher is presented. The chemical mechanical polisher apparatus and method uses a section of a polishing pad kept disposed under tension between supply and receive spools with a motor providing the tension to either spool and the other being locked. If a new pad section is needed, the same motor providing the tension will advance the polishing pad a determined amount. The described invention for a bi-directional linear polishing apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 6,179,695, a method and apparatus for chemical mechanical polishing is presented capable of polishing a surface very precisely at a high speed irrespective of the presence of a local defect on the surface to be polished using a multiplex ring-shaped polishing pad that effectively increases the surface to be polished and very precise and uniform polishing can be performed at high speed. Using a plurality of polishing pads, having different diameters smaller than the diameter of the surface to be polished, provided with an interval on the same revolution radius on a revolution table, very precise and uniform polishing is achieved. The described invention for a chemical mechanical polishing method and apparatus however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 6,612,904, a field controlled polishing apparatus is presented, which includes a polishing pad, a bladder, a fluid and a flux guide where the bladder containing fluid supports the polishing pad positioned adjacent to the surface to be polished. Flux guides positioned along a portion of the bladder, direct a field or a magnetic flux to selected locations of the bladder. The method of polishing a surface adjusts the field or the magnetic flux emanating from the flux guides which changes the mechanical properties of the fluid and by adjusting the magnitude of the field or magnetic flux flowing from the guides, independent pressure adjustments occur at selected locations of the bladder that control the polishing profile of the surface. The described field controlled polishing apparatus invention however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. patent application Ser. No. 09/893,625, a polishing apparatus is presented for polishing a workpiece such as a semiconductor wafer and allows the polishing pad to be automatically replaced without stopping rotary or circulatory motion of a polishing table, which comprises a polishing table for rotary motion, a top ring above the polishing table for holding the workpiece to be polished, a pair of rolls rotatable about their own axes, movable in unison with the polishing table and a polishing pad which is wound on one of the rolls and supplied over an upper surface of the polishing table toward the other of the rolls. The described polishing apparatus invention however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

As illustrated in U.S. Pat. No. 4,993,190, a polishing apparatus invention is presented for polishing optical components and mechanical parts requiring a high surface precision, such as lenses and mirrors by pressing a running tape to such components. The described polishing apparatus invention however, does not propose a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming conditioning or reflattening of the lapping plate.

Note that the above methods and apparatus for automated lapping and polishing of optical components, semiconductor and optoelectronic materials do not envision, nor describe a linear, automated apparatus and method for clean, high purity, simultaneous lapping and polishing of optics, semiconductors and optoelectronic materials using a circular, corrosion resistant stainless steel or nickel lapping plate with affixed circular synthetic nylon or rayon pad that allows clean, high purity water based abrasives to be utilized, whereby material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate that fully eliminates the need for periodic, time consuming, labor intensive conditioning or reflattening of the lapping plate.

BRIEF SUMMARY OF THE INVENTION

The challenges associated with realizing a system capable of simultaneously lapping and polishing optical components as well as semiconductors and optoelectronic materials using clean, high purity water based abrasive slurry without having to periodically condition or reflatten the lapping plate, by using a stable, linear, reciprocating back and forth translation of the workpiece carrier with affixed workpiece, diametrically traversing the circular lapping plate covered with a synthetic nylon or rayon pad to effect material removal, can be overcome using the method and apparatus of the present invention. The linear, automated apparatus and method for clean, high purity, simultaneous lapping and polishing of optical components, semiconductors and optoelectronic materials is intended to provide a clean, stable and reliable system for simultaneously lapping and polishing the full range of optical, semiconductor and optoelectronic materials using high purity, water based abrasive slurry, effecting material removal from the workpiece by the linear, reciprocal back and forth movement of the workpiece holder and affixed workpiece, diametrically across the circular lapping plate rather than using the more commonly encountered arrangement whereby a circular lapping plate rotates about its own central axis to abrade the workpiece, which in turn is positioned at the periphery or near the circumference or outer edge of the rotating lapping plate by the workpiece holder. The linear, automated lapping and polishing apparatus and method of the present invention ensures a uniform wear of the circular lapping plate and synthetic nylon or rayon pad cladding, thereby eliminating the need for periodic, time consuming conditioning or reflattening of the lapping plate.

In the present invention, three types of mechanical movements occur in the apparatus, consisting first, of the primary linear reciprocating movement of the workpiece holder and affixed workpiece, diametrically across the circular lapping plate supporting a synthetic nylon or rayon pad and fabricated from corrosion resistant stainless steel or nickel. The workpiece is held fixed to the workpiece holder using vacuum. The second type of mechanical movement in the apparatus takes the form of an intermittent rotation of the workpiece holder and affixed workpiece about its own axis in step increments, tracing arcs of 180 degrees, first in a clockwise and subsequently counterclockwise direction. The purpose of such intermittent stepwise rotation of the workpiece holder is to ensure uniform abrading of material from the full area of the workpiece which is maintained in contact with the nylon or rayon pad supported by the circular, stainless steel or nickel lapping plate. The third type of mechanical movement in the apparatus takes the form of intermittent rotation of the circular lapping plate for the sole purpose of ensuring a uniform wear on the circular nylon or rayon pad and lapping plate, that fully eliminates the need for periodic, time consuming conditioning or reflattening of the lapping plate.

The preferred embodiment, of the design of the linear, automated apparatus and method for clean, high purity, simultaneous lapping and polishing of optics, semiconductors and optoelectronic materials of the present invention, consists of a flat stainless steel or aluminum breadboard having a plurality of evenly spaced holes on an array grid, supporting a circular stainless steel or nickel lapping plate at the center, that can be rotated either manually about its central axis or by a motorized actuator. Four stainless steel vertical rod support columns mounted in adjacent pairs and at opposite ends of the circular lapping plate, provide a means to affix a stainless steel rod, sliding linear shaft, supported by two flanged stainless steel linear ball bearings installed in stainless steel bulkheads, diametrically opposite from each other and supported between the two vertical rod support columns on diametrically opposite sides of the lapping plate. The stainless steel rod, sliding linear shaft can be raised or lowered to the correct height above the circular lapping plate, supported by the four stainless steel vertical rod columns. The workpiece holder uses vacuum to retain the workpiece flush to a flat surface and is itself installed in a position, suspended at the midway point beneath the stainless steel rod, sliding linear shaft. Supported by the linear ball bearings, the workpiece holder has three degrees of freedom of displacement including linear movement in a direction parallel with the sliding linear shaft's axis, rotational movement about its own central axis as provided by a motorized actuator and thirdly, rotation about the axis parallel with the stainless steel rod, sliding linear shaft, the latter capability allowing for gravity to align the workpiece affixed to the workpiece holder perfectly flat and in full contact with the lapping and polishing pad supported by the circular lapping plate of the apparatus. The continuous, automated, linear reciprocal translation or displacement of the stainless steel shaft with affixed, suspended workpiece holder and workpiece, diametrically across the surface of the circular lapping plate, is accomplished using a motorized linear actuator. Similarly, intermittent rotational movement of the workpiece holder and affixed workpiece about its own axis in step increments, tracing arcs of 180 degrees, first in a clockwise and subsequently counterclockwise direction is accomplished using a motorized rotational actuator affixed directly to, and positioned above the workpiece holder.

In summary, the principal advantages of the linear, automated apparatus and method for clean, high purity, simultaneous lapping and polishing of optics, semiconductors and optoelectronic materials of the present invention, include first and foremost the cleanliness and cost-effectiveness of the automated system which is fabricated almost entirely from corrosion resistant stainless steel and/or nickel, allowing high purity water based abrasive slurry to be utilized. The method and apparatus of the present invention, supports automated, simultaneous lapping and polishing of optics, semiconductors and optoelectronic materials using a circular, corrosion resistant stainless steel or nickel lapping plate supporting a circular, synthetic nylon or rayon pad that allows clean, high purity water based abrasives to be utilized, whereby material is abraded from the workpiece primarily through the linear, reciprocal, back and forth movement of the workpiece holder diametrically across the circular lapping plate, with intermittent rotation in angular step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate, that fully eliminates the need for periodic, time consuming conditioning or reflattening of the lapping plate.

BRIEF DESCRIPTION OF THE SEVERAL VIEWS OF THE DRAWING

These and other features of the subject of the invention will be better understood with connection with the Detailed Description of the Invention in conjunction with the Drawings, of which.

DETAILED DESCRIPTION OF THE INVENTION

Figure 1:
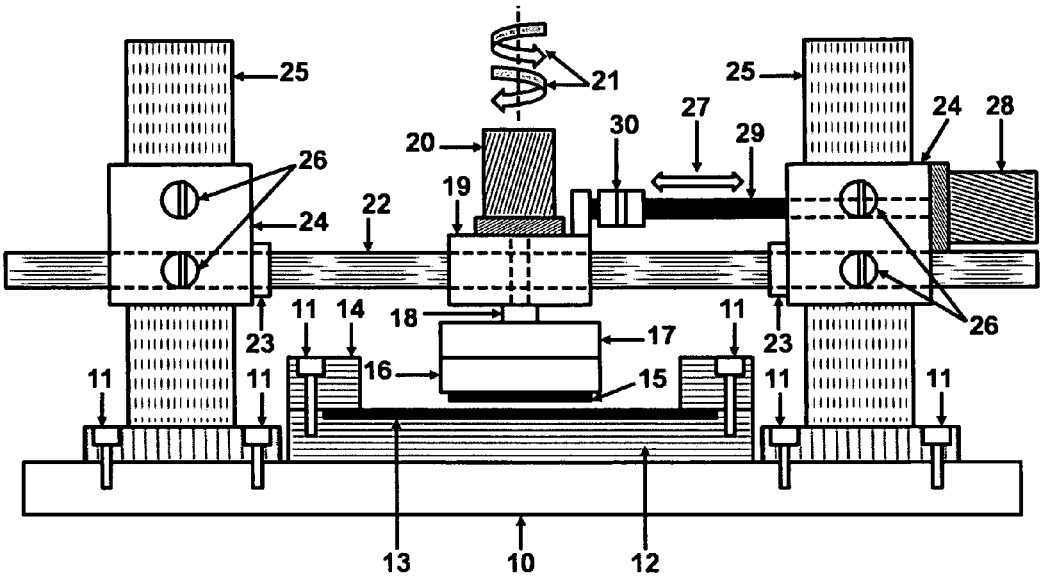
FIG. 1 illustrates the linear, automated apparatus and method for clean, high purity, simultaneous lapping and polishing of optics, semiconductors and optoelectronic materials using a continuous, linear, reciprocal motion of the workpiece that is in contact with a polishing pad supported by the stainless steel or nickel lapping plate, the latter only rotating intermittently to ensure uniform wear and obviate the need for conditioning or reflattening of the lapping plate.

Referring to FIG. 1, a depiction is shown of the linear, automated apparatus and method for clean, cost-effective simultaneous lapping and polishing of optics, semiconductors and optoelectronic materials. The linear, automated lapping and polishing system is fabricated almost entirely from corrosion resistant stainless steel and/or nickel, allowing high purity water based abrasive slurry to be utilized. The method and apparatus of the present invention, supports automated, simultaneous lapping and polishing of optics, semiconductors and optoelectronic materials using a circular, corrosion resistant stainless steel or nickel lapping plate supporting a circular, synthetic nylon or rayon pad that allows clean, high purity water based abrasives to be utilized. Material is abraded from the workpiece primarily through the linear, reciprocal back and forth movement of the workpiece holder diametrically across the circular lapping plate, with intermittent rotation in step increments of the workpiece holder and affixed workpiece, tracing arcs of 180 degrees, first in a clockwise and subsequently counterclockwise direction. Intermittent rotation of the circular lapping plate for the sole purpose of ensuring uniform wear on the circular nylon or rayon pad and lapping plate, fully eliminates the need for periodic, time consuming conditioning or reflattening of the lapping plate. The apparatus of the present invention, in a preferred embodiment consists of an aluminum or stainless steel rectangular plate 10, of 18" length and 12" width, having a plurality of tapped holes drilled through, forming a regular array of holes that support mounting of various components to the plate 10 using for example socket head cap screws 11. The circular stainless steel or nickel lapping plate 12, supports a circular, synthetic nylon or rayon pad 13 to enable clean, simultaneous lapping and polishing of optics, semiconductor and optoelectronic materials using high purity water based abrasive slurry. The synthetic nylon or rayon pad 13 is held fixed in place by a stainless steel or nickel ring 14, bolted with socket head cap screws 11 to the lapping plate 12, to prevent it from sliding out of position as the workpiece 15 is brought into contact with the pad 13 to be lapped and polished.

The workpiece 15 is held firmly in place, affixed to a stainless steel or nickel flange flat surface 16 having a diameter slightly larger than the workpiece 15, using vacuum suction. The vacuum chuck assembly or, workpiece holder consisting of the lower flange 16 affixed to an upper flange 17, is suspended at its central axis location 18 beneath a stainless steel bulkhead 19 enabling the workpiece holder and affixed workpiece 15 to rotate freely about its central axis. A motorized rotational stage 20 intermittently rotates 21 the workpiece holder assembly with affixed workpiece 15 about its axis in step increments, tracing arcs of 180 degrees, first in a clockwise and subsequently counterclockwise direction to assure uniform lapping and polishing of the workpiece. The stainless steel bulkhead 19 supporting the motorized rotational stage 20 and workpiece holder, is itself affixed to a stainless steel rod, linear shaft 22 having a 0.5" diameter and 24" length and supported on two linear bearings 23. The flanged linear bearings 23 supporting the stainless steel rod, linear shaft 22, are installed diametrically opposite from each other in stainless steel bulkheads 24, the latter having an adjustable height positioning capability. The stainless steel bulkheads 24 are mounted on vertical stainless steel rod columns 25, permitting accurate vertical positioning of the workpiece holder by raising and lowering of the stainless steel bulkheads 24 supporting the stainless steel rod, linear shaft 22 and using softpoint setscrews 26 to fix the vertical position of the stainless steel bulkhead 24.

The linear, automated lapping and polishing method utilized in the apparatus to abrade or remove material from the workpiece 15 utilizes primarily the linear, reciprocal movement 27 of the stainless steel rod, linear shaft 22 with affixed workpiece holder and workpiece 15 diametrically across the circular lapping plate 12, enabled by a motorized linear translator 28 having a connector rod 29 affixed via a flexible stainless steel bellows coupling 30 to the stainless steel bulkhead 19 to which is affixed the motorized rotational stage 20, workpiece holder and workpiece 15. Supported by the linear bearings 23, the workpiece holder has three degrees of freedom of displacement including linear movement axially along the length of the linear shaft 22 as provided by a motorized linear actuator 28, rotational movement about its own central axis 21 as provided by a motorized rotational actuator 20 and thirdly free rotation about the axis parallel with the linear shaft 22, the latter capability allowing for gravity to align the workpiece 15 affixed to the workpiece holder perfectly flat and in full contact with the lapping and polishing pad 13 supported by the circular lapping plate 12 of the apparatus.

In the present invention, three types of mechanical movements occur in the apparatus, consisting first of the primary linear reciprocating movement 27 of the workpiece holder and affixed workpiece 15, diametrically across the circular lapping plate 12 supporting a synthetic nylon or rayon pad 13 and fabricated from corrosion resistant stainless steel or nickel. The second type of mechanical movement in the apparatus takes the form of an intermittent rotational movement 21 of the workpiece holder and affixed workpiece 15 about its own axis in angular step increments, tracing arcs of 180 degrees, first in a clockwise and subsequently counterclockwise direction. The purpose of such intermittent stepwise rotation of the workpiece holder is to ensure uniform abrading of material from the full area of the workpiece in contact with the nylon or rayon pad 13 supported by the circular, stainless steel or nickel lapping plate 12. The third type of mechanical movement in the apparatus takes the form of an intermittent rotation of the circular lapping plate 12 about its central axis for the sole purpose of ensuring uniform wear on the circular nylon or rayon pad 13 and lapping plate 12 that fully eliminates the need for periodic, time consuming conditioning or reflattening of the lapping plate.

Figure 2:
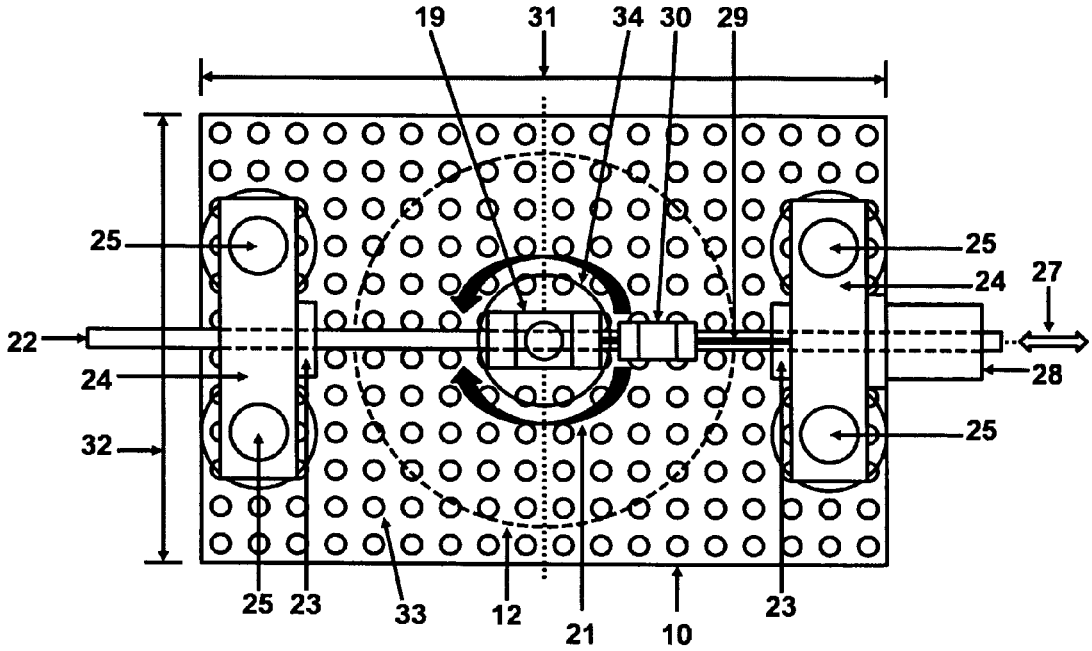
FIG. 2 illustrates a top view of the linear, automated apparatus and method for clean, high purity, simultaneous lapping and polishing of optics, semiconductors and optoelectronic materials using a continuous, linear, reciprocal motion of the workpiece that is in contact with a polishing pad supported by the stainless steel or nickel lapping plate, the latter only rotating intermittently to ensure uniform wear and obviate the need for conditioning or reflattening of the lapping plate.

Referring to FIG. 2, a top view of the apparatus for linear, automated simultaneous lapping and polishing of optics, semiconductors and optoelectronic materials is shown. The linear, automated lapping and polishing apparatus of the present invention consists in the preferred embodiment of an aluminum or stainless steel rectangular plate 10, of 18" length 31 and 12" width 32, having a plurality of tapped holes 33 drilled through, forming a regular array of holes that support mounting of various components to the plate 10. The circular outline 12 of the 10" diameter stainless steel or nickel lapping plate is indicated. Four mounting posts 25 are affixed to the rectangular plate 10 in adjacent pairs, diametrically opposite from each other. The stainless steel bulkheads 24 are supported on the two adjacent mounting posts 25 allowing vertical translation or positioning of the bulkheads 24. Two linear bearings 23 are installed in the bulkheads 24 opposing each other diametrically across the lapping plate 12 to support the 0.5" diameter and 24" long stainless steel rod, linear shaft 22. The workpiece holder 34 is suspended beneath the stainless steel bulkhead 19 that is in turn affixed to the stainless steel rod, linear shaft 22. The linear, automated lapping and polishing of the workpiece that is affixed to the workpiece holder 34, is effected by the linear 27, reciprocal, back and forth, movement of the workpiece holder 34 diametrically across the circular lapping plate 12, enabled by the motorized linear translator 28 having a connector rod 29 affixed via a flexible stainless steel bellows coupling 30 to the stainless steel bulkhead 19. Intermittent rotation 21 in step increments of the workpiece holder 34 and affixed workpiece occurs, tracing arcs of 180 degrees, first in a clockwise and subsequently counterclockwise direction, and with further intermittent rotation of the circular lapping plate 12, the latter for the sole purpose of ensuring a uniform wear on the circular nylon or rayon pad and lapping plate, that fully eliminates the need for periodic, time consuming conditioning or reflattening of the lapping plate 12.

Figure 3:
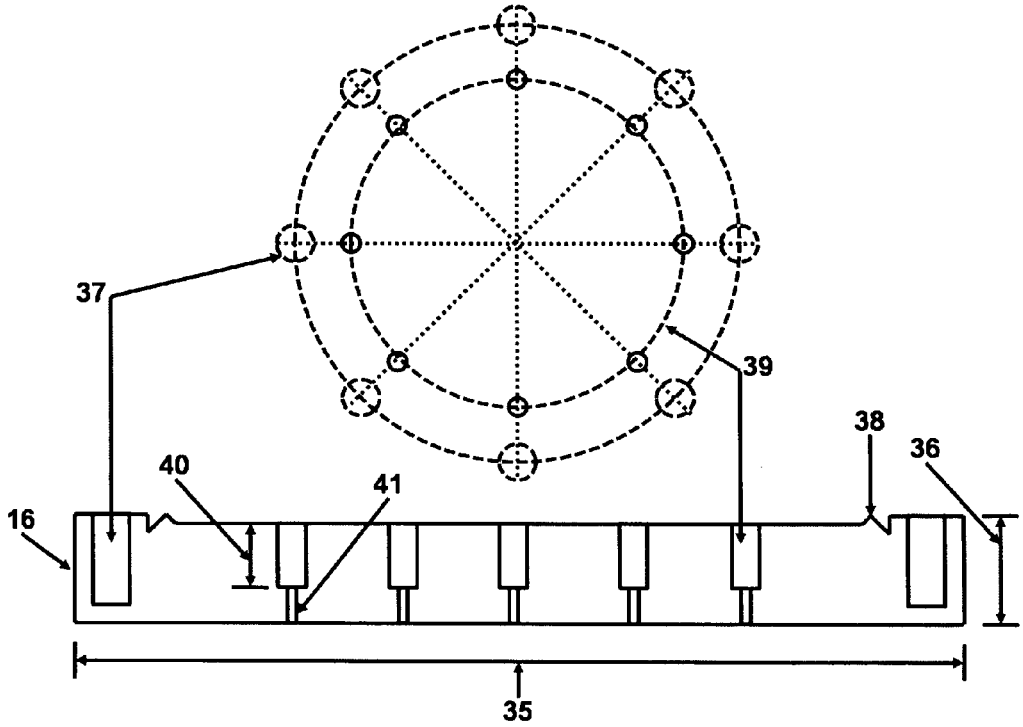
FIG. 3 illustrates the detail of the lower flange of the workpiece holder that has a knife edge side and a flat side, with a plurality, of small diameter clearance holes drilled through the flange, to enable vacuum to be utilized to firmly retain to the flat side of the flange the workpiece requiring lapping and polishing.

Referring to FIG. 3, the lower flange 16 of the vacuum chuck assembly or workpiece holder is shown in detail. The circular lower flange 16 of the workpiece holder is shown to have a diameter 35 of 3.375" and thickness 36 of 0.687" and is capable of retaining wafers of 2" or 3" diameter. The circular lower flange 16 has eight blind tapped holes 37 drilled to a 0.5" depth and situated on a 2.85" diameter bolt circle utilized for sealing hermetically the lower flange 16 to the upper flange of the workpiece holder via the knife edge ring 38. An additional set of eight clearance holes 39 drilled to a first 0.5" depth at 0.125" diameter 40 followed by the remainder drilled length having 0.03125" diameter 41 enable vacuum to be used to firmly hold the workpiece to the flat face of the lower flange 16.

Figure 4:
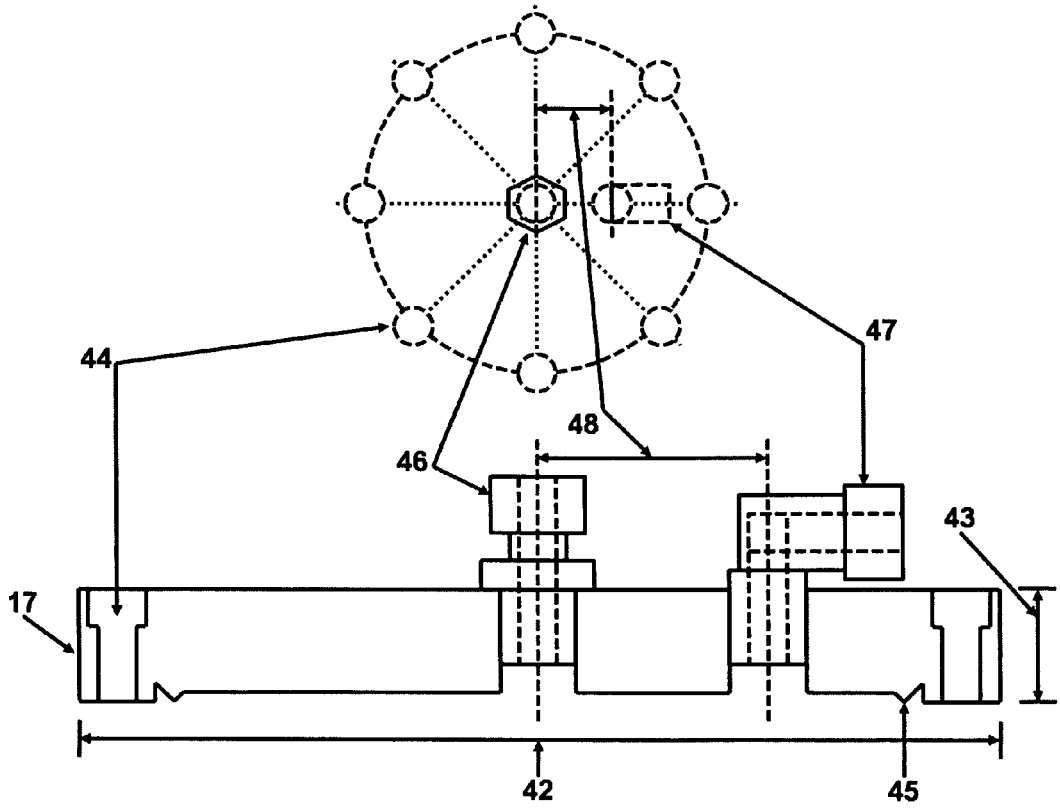
FIG. 4 illustrates the detail of the upper flange of the workpiece holder that has a knife edge side to mate with the knife edge of the lower flange in FIG. 3, as well as compression fittings welded into the flat, non knife edge side which allow firstly, vacuum to be drawn to hold the workpiece firmly to the workpiece holder as well as to affix the workpiece holder to the motorized rotational motion actuator, allowing it to be rotated about its own axis in step increments, tracing arcs of 180 degrees, first in a clockwise and subsequently counterclockwise direction to ensure uniform lapping and polishing of the workpiece.

Referring to FIG. 4, the upper flange 17 of the vacuum chuck assembly or workpiece holder is shown in detail. The circular upper flange 17 of the workpiece holder is shown to have a diameter 42 of 3.375" and thickness 43 of 0.687". The circular upper flange 17 has eight counter bored clearance holes 44 and situated on 2.85" diameter bolt circle matching the holes of the lower flange 16 in FIG. 3 of the workpiece holder utilized for sealing hermetically the upper flange 17 to the lower flange of the workpiece holder via the knife edge ring 45. The bored through compression fitting 46 capable of accommodating a 0.25" diameter shaft is welded directly in the center of the circular upper flange 17. The central welded compression fitting 46, is meant to accept the drive shaft from the rotational motorized actuator that intermittently rotates in step increments the workpiece holder and affixed workpiece, tracing arcs of 180 degrees, first in a clockwise and subsequently counterclockwise direction to effect uniform abrading of material from the workpiece. A second right angle oriented compression fitting 47, is welded to the circular upper flange 17 of the workpiece holder, displaced a distance 48 of 0.625" from the center axis of the flange. The right angle compression fitting 47, allows a vacuum hose to be connected to the workpiece holder to retain the workpiece flush with the flat face of the lower flange comprising the workpiece holder.

Figure 5:
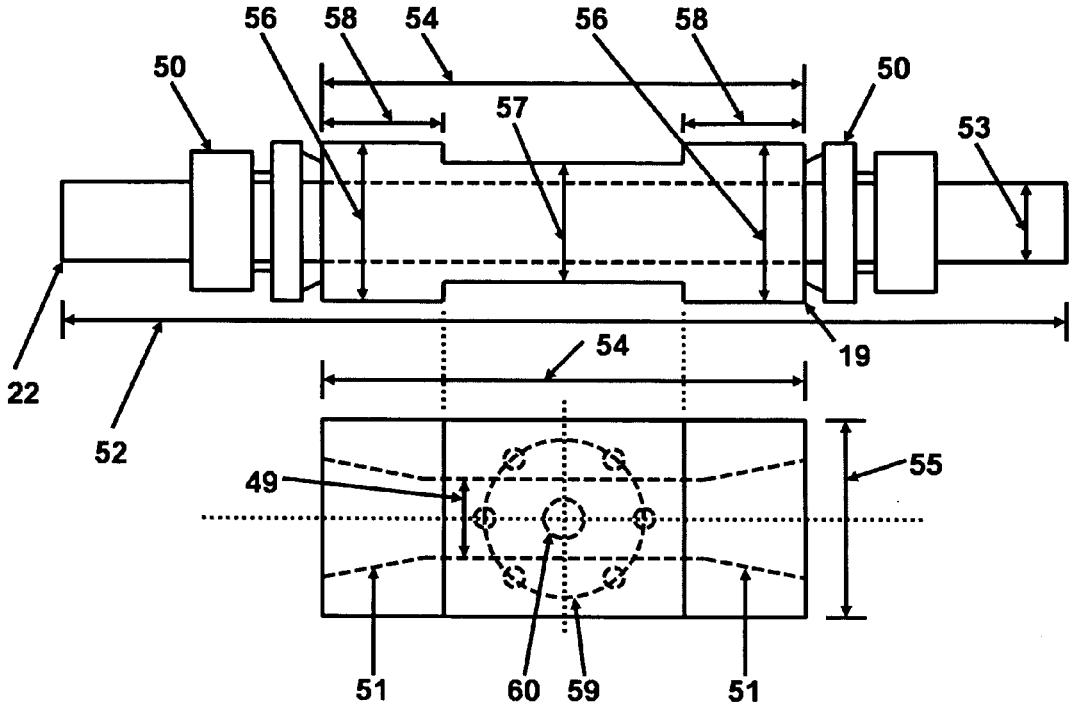
FIG. 5 illustrates the detail of the stainless steel bulkhead installed at the midway point of the stainless steel rod, linear shaft that supports the motorized rotational actuator and from whose drive shaft is suspended the workpiece holder with affixed workpiece.

Referring to FIG. 5, the stainless steel bulkhead 19 shown in detail, has a clearance hole 49 along its full length, permitting it to be affixed at the midway point of the stainless steel rod, linear shaft 22 using a pair of compression fittings 50 that are threaded into the stainless steel bulkhead 19 using a 0.5" size male pipe thread 51. The stainless steel rod, linear shaft 22 has an overall length 52 of 24" and diameter 53 of 0.5", passes through the clearance hole 49 in the stainless steel bulkhead 19 enabling the linear reciprocal movement of the workpiece holder and affixed workpiece to abrade material and effect the linear lapping and polishing of the workpiece. The stainless steel bulkhead 19, has an overall length 54 of 3", a width 55 of 1.5" and height at the ends 56 of 1" and height in the center 57 of 0.75". The thicker, end sections 58 of the bulkhead 19 have a length each of 0.75". The central section of the stainless steel bulkhead 19 having a height 57 of 0.75" has a tapped six hole pattern 59 on a 1.062" bolt circle to allow mounting of the motorized rotary actuator whose cylindrical drive shaft passes through the center clearance hole 60 and supports affixing of the workpiece holder to said cylindrical shaft of the motorized rotary actuator.

Figure 6:
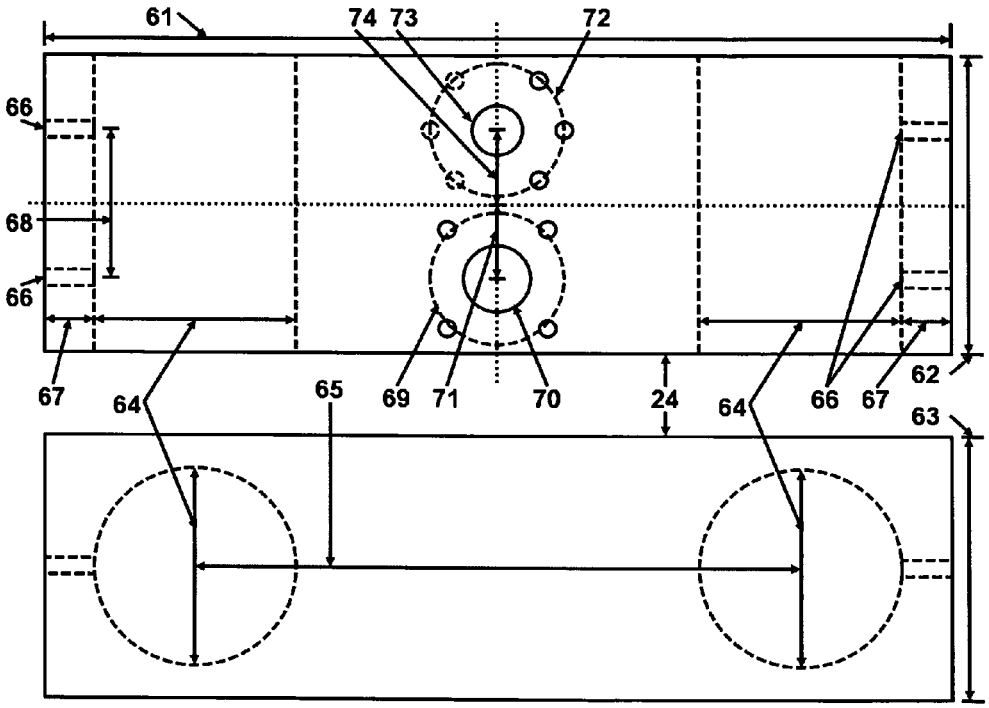
FIG. 6 illustrates the detail of the stainless steel bulkhead that supports the flanged linear bearing as well as the motorized linear actuator of the lapping and polishing apparatus where the said stainless steel bulkhead is installed onto a pair of vertical posts allowing the height of the stainless steel rod, linear shaft and workpiece holder to be fixed relative to the lapping plate.

Referring to FIG. 6, the stainless steel bulkhead 24 that supports the flanged linear bearing of the linear, automated lapping and polishing apparatus of the present invention is shown in detail. Two such stainless steel bulkheads 24 with installed linear ball bearings are mounted diametrically opposite from each other on a pair of vertical stainless steel posts 25 in FIG. 2 to support the stainless steel rod, linear shaft that in turn supports the workpiece holder. The stainless steel bulkhead 24 has a length 61 of 7.5", a height 62 of 2.5" and thickness 63 of 2.0". Two large clearance holes 64 having a diameter of 1.505" separated by a center to center distance 65 of 5.0" allow the stainless steel bulkhead 24 to be installed and vertically positioned on the vertical stainless steel posts 25 in FIG. 2 of the apparatus. A total of four holes for set screws 66 tapped to depth 67 of 0.5", and grouped in pairs on either side of the bulkhead 24, are separated by a distance 68 of 1.25". The stainless steel bulkhead 24 has four tapped holes on a 1.312" bolt circle 69 with a clearance hole 70 in the center of said bolt circle 69 having a diameter of 0.880" to allow installation of a flanged linear bearing. The distance 71 of the clearance hole 70 from the center line of the stainless steel bulkhead 24 is 0.625". The stainless steel bulkhead 24 has a further six tapped holes on a 1.062" bolt circle 72 with a clearance hole 73 in the center of said bolt circle 72 having a diameter of 0.3125" to allow installation of the motorized linear actuator of the apparatus. The distance 74 of the clearance hole 73 from the center line of the stainless steel bulkhead 24 is 0.585".

In summary, a novel apparatus, and method for implementing clean, linear, automated, simultaneous lapping and polishing of optics, semiconductors and optoelectronic materials has been developed. The novel apparatus of the present invention is constructed from corrosion resistant stainless steel and/or nickel, allowing high purity water based abrasive slurry to be utilized. The method and apparatus of the present invention, supports automated, simultaneous lapping and polishing of optics, semiconductors and optoelectronic materials using a circular, corrosion resistant stainless steel or nickel lapping plate supporting a circular, synthetic nylon or rayon pad that allows clean, high purity water based abrasives to be utilized, whereby material is abraded from the workpiece primarily through the linear, reciprocal back and forth movement of the workpiece holder and affixed workpiece, diametrically across the circular lapping plate, with intermittent rotation in step increments of the workpiece holder and affixed workpiece, tracing arcs of 180 degrees, first in a clockwise and subsequently counterclockwise direction, and with further intermittent rotation of the circular lapping plate, the latter for the sole purpose of ensuring a uniform wear on the circular nylon or rayon pad and lapping plate, that fully eliminates the need for periodic, time consuming conditioning or reflattening of the lapping plate.

The invention claimed is:

1. A method for linear, simultaneous lapping flat and polishing of optics or semiconductors or optoelectronic materials using high purity water based abrasive slurry, comprising the steps of:

affixing a workpiece to a workpiece holder using vacuum wherein said workpiece comprises said optics or semiconductors or optoelectronic materials; and lowering said workpiece held fixed by said vacuum to said workpiece holder onto a circular synthetic polishing pad wherein said circular synthetic polishing pad is affixed to a circular corrosion resistant lapping plate of equal or larger diameter than said circular synthetic polishing pad, for providing rigid mechanical support to said circular synthetic polishing pad, and wherein said circular synthetic polishing pad is loaded with said high purity water based abrasive slurry for said simultaneous lapping flat and polishing of said workpiece; and continuously displacing said workpiece held fixed by said vacuum to said workpiece holder by linear reciprocal translation of said workpiece holder diametrically across said circular synthetic polishing pad affixed to said circular corrosion resistant lapping plate, for said simultaneous lapping flat and polishing of said workpiece; and intermittently rotating said workpiece held fixed by said vacuum to said workpiece holder about the center axis of said workpiece holder during said linear reciprocal translation of said workpiece holder diametrically across said circular synthetic polishing pad affixed to said circular corrosion resistant lapping plate, to provide uniform material removal from the full area of said workpiece; and intermittently rotating said circular corrosion resistant lapping plate about the center axis of said circular corrosion resistant lapping plate during said linear reciprocal translation of said workpiece holder diametrically across said circular synthetic polishing pad affixed to said circular corrosion resistant lapping plate, to provide uniform wear of said circular synthetic polishing pad, thereby eliminating the need for periodic reflattening of said circular synthetic polishing pad and said circular corrosion resistant lapping plate; and raising said workpiece held fixed by said vacuum to said workpiece holder from said circular synthetic polishing pad after completion of said simultaneous lapping flat and polishing of said workpiece to recover said workpiece.

2. A method according to claim 1 in which said workpiece holder comprises stainless steel or nickel.

3. A method according to claim 1 in which said circular synthetic polishing pad comprises synthetic nylon or rayon.

4. A method according to claim 1 in which said circular corrosion resistant lapping plate comprises stainless steel or nickel.

5. A method according to claim 1 in which said workpiece holder is continuously displaced by said linear reciprocal translation diametrically across said circular synthetic polishing pad using a slide shaft rod, wherein said slide shaft rod is supported by linear bearings on opposite ends of said slide shaft rod.

6. A method according to claim 5 in which said linear bearings are installed in linear bearing bulkheads wherein said linear bearing bulkheads are positioned diametrically opposite across said circular corrosion resistant lapping plate supporting said circular synthetic polishing pad and wherein said linear bearing bulkheads are mounted on vertical posts, thereby permitting lowering and raising, of said workpiece held fixed by said vacuum to said workpiece holder, onto and from said circular synthetic polishing pad.

7. A method according to claim 5 in which said slide shaft rod comprises a machined bulkhead wherein said machined bulkhead is positioned at the midway point of said slide shaft rod.

8. A method according to claim 7 in which said workpiece holder is coupled directly to the drive shaft of a rotary actuator wherein said rotary actuator is affixed to said machined bulkhead.

9. A method according to claim 7 in which said machined bulkhead is coupled to the connector rod of a linear actuator wherein said linear actuator is affixed to said linear bearing bulkhead.

* * * * *